US009909716B2

(12) United States Patent
Frenal

(10) Patent No.: US 9,909,716 B2
(45) Date of Patent: Mar. 6, 2018

(54) PLUG FOR A FLUID COUPLING, CORRESPONDING VALVE, BOTTLE AND FILLING METHOD

(71) Applicant: L'Air Liquide, Société Anonyme pour l'Etude et l'Exploitation des Procédés Georges Claude, Paris (FR)

(72) Inventor: Antoine Frenal, Ezanville (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 547 days.

(21) Appl. No.: 14/405,638

(22) PCT Filed: Mar. 18, 2013

(86) PCT No.: PCT/FR2013/050560
§ 371 (c)(1),
(2) Date: Dec. 4, 2014

(87) PCT Pub. No.: WO2013/182764
PCT Pub. Date: Dec. 12, 2013

(65) Prior Publication Data

US 2015/0167896 A1 Jun. 18, 2015

(30) Foreign Application Priority Data

Jun. 4, 2012 (FR) ..... 12 55164

(51) Int. Cl.
*F17C 13/04* (2006.01)
*F17C 13/06* (2006.01)
(Continued)

(52) U.S. Cl.
CPC ..... *F17C 13/04* (2013.01); *B65B 3/04* (2013.01); *B65B 7/2828* (2013.01); *F17C 13/06* (2013.01);
(Continued)

(58) Field of Classification Search
CPC .. F17C 13/06; F17C 2205/0308; F16K 35/00; B65D 41/34; B65D 41/3419;
(Continued)

(56) References Cited

U.S. PATENT DOCUMENTS 3,534,523 A * 10/1970 Davidson ..... B65B 3/16 53/268
6,705,362 B2 * 3/2004 Pisot ..... F16K 1/303 141/301
7,134,449 B2 * 11/2006 Frederiksen ..... G01L 19/10 116/285
7,886,899 B2 * 2/2011 Frutin ..... B65D 51/2892 206/221
(Continued)

FOREIGN PATENT DOCUMENTS

DE 10308676 A1 * 9/2004 ..... F17C 13/06
EP 1 274 957 1/2003

OTHER PUBLICATIONS

French Search Report and Written Opinion for corresponding FR 1255164, dated Jan. 31, 2013.
(Continued)

*Primary Examiner* — Gloria R Weeks
*Assistant Examiner* — William A Weller
(74) *Attorney, Agent, or Firm* — Elwood L. Haynes

(57) ABSTRACT

A stopper for fluid coupling and including a self-locking sheath designed to be slipped onto a connector, the sheath extending about a central longitudinal axis and including on its inner surface and at a first end, a tapped portion designed to engage with a mating threaded portion formed on the outer surface of the connector where the tapped portion includes at least one recess parallel to the longitudinal axis, where the inner surface of the sheath includes, at a second end opposite the first end, a spindle extending inside the sheath in a direction parallel to the longitudinal axis towards the second end of the sheath as far as a free end located between the first and second ends of the sheath, the free end of the spindle being designed to form a protective cover for
(Continued)

a surface of the connector designed to engage with a filling tool.

10 Claims, 3 Drawing Sheets

(51) Int. Cl.
*B65B 3/04* (2006.01)
*B65B 7/28* (2006.01)

(52) U.S. Cl.
CPC ..... *F17C 2205/0308* (2013.01); *F17C 2205/0394* (2013.01); *F17C 2221/011* (2013.01); *F17C 2221/014* (2013.01); *F17C 2221/018* (2013.01); *F17C 2223/0123* (2013.01); *F17C 2223/035* (2013.01); *F17C 2270/0745* (2013.01); *Y10T 137/7043* (2015.04); *Y10T 137/7062* (2015.04); *Y10T 137/7069* (2015.04); *Y10T 137/71* (2015.04)

(58) Field of Classification Search
CPC ..... B65D 41/3423; B65D 41/3438; B65D 41/3457; B65B 7/2828
USPC ..... 222/630, 3, 153.11; 53/467, 468, 471; 141/18, 21, 383, 384, 351; 137/377, 382, 137/382.5, 383, 384
See application file for complete search history.

(56) References Cited

U.S. PATENT DOCUMENTS 8,590,749 B2 * 11/2013 Beranger ..... B05B 11/3049 222/153.09
8,925,756 B2 * 1/2015 Tarapata ..... F16J 15/02 215/247
9,206,909 B2 * 12/2015 Collison ..... F16K 41/10
2003/0127138 A1 * 7/2003 Zinelli ..... F16K 35/10 137/382
2009/0014453 A1 * 1/2009 Bleys ..... F17C 1/14 220/581
2009/0032609 A1 * 2/2009 Ziesel ..... B67D 1/0044 239/10
2009/0145872 A1 * 6/2009 Pagneux ..... B65D 41/08 215/201
2012/0192967 A1 * 8/2012 Zeyfang ..... F17C 13/06 137/382
2013/0118641 A1 * 5/2013 Beranger ..... B05B 11/001 141/363
2014/0124056 A1 * 5/2014 Zeyfang ..... F17C 13/04 137/382
2015/0353246 A1 * 12/2015 Coupland ..... B65D 55/145 215/208

OTHER PUBLICATIONS

International Search Report and Written Opinion for corresponding PCT/FR2013/050560, dated Jun. 18, 2013.

* cited by examiner

PLUG FOR A FLUID COUPLING, CORRESPONDING VALVE, BOTTLE AND FILLING METHOD

CROSS REFERENCE TO RELATED APPLICATIONS

This application is a 371 of International PCT Application PCT/FR2013/050560 filed Mar. 18, 2013 which claims priority to French Patent Application No. 1255164 filed Jun. 4, 2012, the entire contents of which are incorporated herein by reference.

BACKGROUND

The present invention relates to a stopper for fluid coupling of a valve of a fluid cylinder, and to a corresponding valve, cylinder and filling method.

SUMMARY

The invention relates more particularly to a stopper for fluid coupling of a valve of a pressurized fluid cylinder, in particular a connector for filling with and possibly withdrawing fluid, the stopper comprising a self-locking sheath designed to be slipped onto a connector, the sheath extending about a central longitudinal axis, the sheath comprising, on its inner surface and at a first end, a tapped portion designed to engage with a mating threaded portion formed on the outer surface of a connector so that it can be screwed onto the latter or unscrewed therefrom by rotation about a direction parallel to the longitudinal axis.

The invention relates in particular to a stopper for protecting a filling connector. The invention notably relates to a removable and reusable stopper which can be used to protect the surface of a filling connector, which surface is designed to engage in a sealed manner with a filling tool. The stopper can be fluidtight or not, so as to close off the filling connector in a fluidtight or non-fluidtight manner.

The invention relates in particular to a valve with or without an integrated regulator for containers of pressurized fluid.

The invention relates in particular but in an entirely non-limiting manner to the devices described in EP1274957. This document describes the use of a stopper designed to be fitted onto a filling connector having a shape which makes access difficult for unauthorized users. The stopper is of non-standard shape requiring an appropriate tool. The stopper described in this document has, in its inner part, a seal in the form of a bellows which fits over the filling connector in order to prevent the ingress of dust. In the event of a leak, the seal deforms and allows gas to be released to the outside.

The structure of this stopper has a plurality of parts which can move relative to each other and a spring to bring it into a locked or unlocked state. This structure increases the risk of incorrect fitting by an operator. Moreover, the bellows of this stopper is at risk of being damaged which can reduce the performance in terms of protection of the connector.

Moreover, where the application requires a sealing stopper, the structure of this stopper does not, however, make it possible to ensure that the connector is sealed, for example in the event that the check valve in the connector leaks.

Finally, it is not possible with this device to check efficiently whether the stopper has been removed and replaced by an unauthorized user.

It is an object of the present invention to provide a solution to all or some of the drawbacks of the prior art which are highlighted above.

To that end, the stopper according to the invention, in all other respects in accordance with the generic definition thereof given in the above preamble, is essentially characterized in that the tapped portion comprises at least one recess parallel to the longitudinal axis, in projection according to a plane perpendicular to the longitudinal axis, the at least one recess being secant with the circle of smaller diameter of the tapping, and in that the inner surface of the sheath comprises, at a second end opposite the first end, a spindle extending inside the sheath in a direction parallel to the longitudinal axis towards the second end of the sheath as far as a free end located between the first and second ends of the sheath, said free end of the spindle being designed to form a protective cover for a surface of the connector designed to engage with a filling tool.

Furthermore, embodiments of the invention can comprise one or more of the following features:

- the sealing member of the free end of the sealing spindle comprises an O-ring housed in a circular groove formed on the free end of the spindle,
- the tapped portion comprises three or four recesses distributed symmetrically about the axis of rotation of the tapping,
- the sheath comprises an open-work body having at least one opening, the stopper comprising a tamper-evident seal distinct from the sheath, the tamper-evident seal being designed to be interposed between the connector and the sheath slipped onto the connector, the tamper-evident seal comprising at least one flexible frangible tab, in the assembled position, the at least one tab being deployed and projecting into the at least one opening of the sheath and acting as a stop preventing the sheath from rotating, the tab being able to be moved mechanically and elastically into a retracted position inside the sheath in order to selectively suppress the rotation-preventing stop,
- the tamper-evident seal comprises a body in the shape of a collar consisting of one or more parts, designed to be fitted around a male connector, the body of the tamper-evident seal comprising a plurality of tabs deployed by default towards the outside of the collar and which can be pressed back elastically towards the inside of the collar in the retracted position,
- the sheath has a generally cylindrical shape, either solid or open-work,
- the sheath material consists of at least one metal,
- the tamper-evident seal comprises two semicircular half-shells designed to be fitted transversely around a connector of generally cylindrical shape,
- the tamper-evident seal comprises an open circular crown having at least one pliable hinge,
- the tamper-evident seal is immobile in the longitudinal direction on the connector between two shoulders of the connector,
- the tamper-evident seal can rotate freely on the connector about the longitudinal axis,
- the angular position of the tamper-evident seal on the connector about the longitudinal axis is indexed by means of at least one stop,
- the tamper-evident seal comprises a plurality of positioning snugs which engage with the outer shape of the connector in order to provide a determined angular positioning and locking of the tamper-evident seal around the connector, unscrewing the stopper relative to the connector without at the same time pressing back the at least one tab into the retracted position produces a force which irreversibly breaks the at least one tab off the rest of the tamper-evident seal, the outer surface of the sheath comprises at least one imprint area designed to engage with a mating shape of a tool for screwing/unscrewing the stopper.

The invention relates to a valve for a pressurized fluid cylinder, comprising an internal gas circuit designed to communicate with the internal volume of a cylinder via at least one control member such as a check valve, the valve comprising a filling connector which communicates with the internal circuit for the purpose of filling the cylinder, the filling connector having a body which extends along a longitudinal axis, the connector comprising a guide end and a threaded portion, the threaded portion being offset in the longitudinal direction relative to said guide end in the direction of the longitudinal axis, the guide end comprising a contour having at least one projection projecting beyond the contour, in projection in a plane perpendicular to said longitudinal axis, the at least one projection of the guide end of the connector being secant with a circle centred on said longitudinal axis and the diameter of which is equal to the smaller of the inner and outer diameters of the threaded portion, the valve comprising a stopper fitted in a removable fashion on the connector, in which the stopper is in accordance with any one of the features above or below and has a shape which mates with said connector, that is to say that the tapping of the stopper engages selectively with the screw thread of the connector and the at least one recess of the stopper mates with the at least one projection of the guide end such that one or a limited number of given angular positions of the stopper on the connector allows the stopper to fit onto the connector such that these two can be screwed together.

According to other possible features:

a tamper-evident seal is interposed around the connector between the guide end and a threaded portion and the stopper is slipped and screwed onto the connector having the tamper-evident seal, when the stopper is slipped and ready to be screwed onto the connector having the tamper-evident seal, the sheath forces the at least one tab into a retracted position in order to allow the stopper to be screwed onto the connector, when the stopper is fitted onto the connector, the at least one tab lining up with with the at least one opening of the sheath in order to allow the at least one tab to move into the deployed position relative to the connector in the at least one opening and form a stop which prevents the stopper from rotating relative to the connector.

The invention can also relate to a pressurized fluid cylinder comprising a valve in accordance with any one of the features above or below.

The invention can also relate to a method for filling such a pressurized fluid cylinder, the method comprising a step of connecting a filling tool onto a connector which does not have a stopper, a step of transferring fluid into the cylinder via the filling tool through the connector, a step of disconnecting the filling tool from the connector and a step of fitting a stopper onto said connector.

According to other possible features:

the step of fitting a stopper onto said connector comprises or does not comprise interposing a tamper-evident seal between the connector and the stopper, the method comprises, before the step of connecting a filling tool onto the connector, a step of removing a stopper present on the connector, the stopper comprises a tamper-evident seal interposed around the connector between the guide end and the threaded portion, the stopper is screwed around the connector having the tamper-evident seal, the preparatory step of removing a stopper attached to the connector possibly comprising mechanically breaking at least part of the tamper-evident seal, the stopper comprising a tamper-evident seal interposed around the connector between the guide end and the threaded portion, the stopper being screwed around the connector having the tamper-evident seal, the preparatory step of removing a stopper attached to the connector does not comprise mechanically breaking part of the tamper-evident seal, removing the stopper comprises, at the same time as unscrewing the stopper, a step during which the at least one tab is pressed back into the retracted position.

The invention can also relate to a tool for fitting or removing the corresponding stopper.

The invention can also relate to any alternative device or method comprising any combination of the features above or below.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
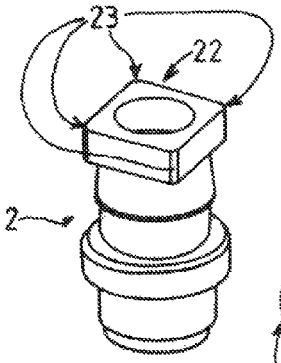
FIGS. 1 to 6 are perspective views each showing a different step in fitting a stopper onto a connector according to a first possible embodiment of the invention.

FIG. 1 shows an example of what is referred to as a "square-head" male filling connector 2, to which the invention can relate. Such a connector 2 is described, in particular, in EP1274957. It is a connector having a particular shape, by means of which unauthorized users or non-approved fluidic connectors are prevented from being connected thereto. Of course, the invention applies to any other type of shape of connector described in the above-mentioned document (for example a triangular-head or other valve). More generally, the invention applies to any other shape of male connector (for filling with and/or for withdrawing fluid) featuring a guide end having one, two or more than two projections offset in the longitudinal direction relative to a threaded portion.

The filling connector 2 has an oblong body of generally cylindrical shape which extends along a longitudinal axis. The connector 2 comprises a terminal guide end 22 designed to engage with a filling tool. The end opposite the guide end 22 is designed to be attached to the body of the valve of a fluid cylinder for example. The connector 2 also comprises a threaded portion 20. The threaded portion 20 is offset in the longitudinal direction relative to said guide end 22 in the direction of the longitudinal axis.

The guide end 22 comprises a contour having at least one projection and, in this example, four projections 23. The projections 23 project beyond the for example cylindrical contour of the end of the connector 2. In projection in a plane perpendicular to said longitudinal axis, the projections 23 of the guide end 22 of the connector 2 are secant with an imaginary circle centred on said longitudinal axis and the diameter of which is equal to the smaller of the inner and outer diameters of the threaded portion 20. The four projections 23 are distributed symmetrically at 90° about the axis of rotation of the screw thread such that, when seen from above (in a plane perpendicular to the longitudinal axis), the guide end has a generally square shape concentric with the screw thread 20 but the corners 23 of which extend beyond the diameter of the screw thread 20.

Figure 2:
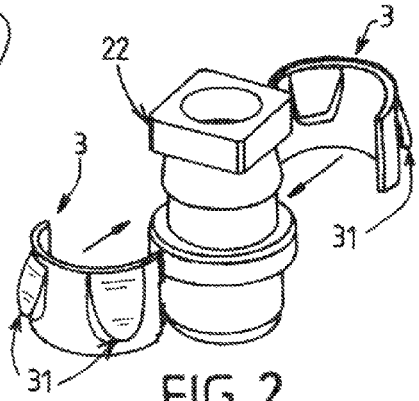
Figure 3:
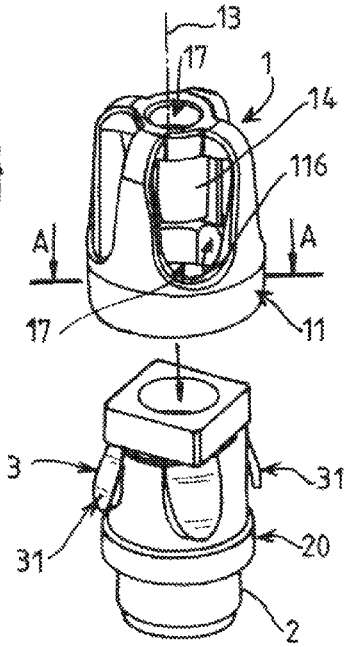

FIGS. 2 and 3 show a stopper 1 being fitted onto the connector 2.

The stopper 1 comprises a self-locking sheath 11 designed to be slipped onto the connector 2. The sheath 11 extends about a central longitudinal axis 13. The sheath 11 comprises, on its inner surface and at a first end, a tapped portion 12 designed to engage with the mating threaded portion 20 of the connector 2 (see FIGS. 7 and 14 in particular).

Figure 7:
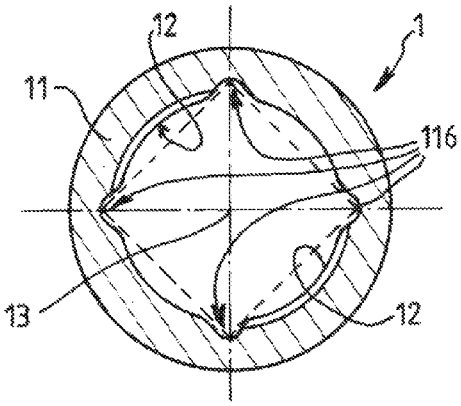
FIG. 7 is a view in transverse section along line AA of FIG. 3 of a portion of the stopper.

As can be seen in FIGS. 3 and 7, the tapped portion 12 comprises four recesses 116 parallel to the longitudinal axis 13. In projection according to a plane perpendicular to the longitudinal axis 13, the recesses are secant with the circle of smaller diameter of the tapping 12.

The recesses 116 mate with the projections 23 of the connector 2. That is to say that the recesses 116 are distributed symmetrically at 90° about the axis of rotation of the tapping 12. In this manner, one or a limited number of given angular positions of the stopper 1 on the connector 2 allows the stopper to fit onto the connector 2 such that these two can be screwed together.

Figure 8:
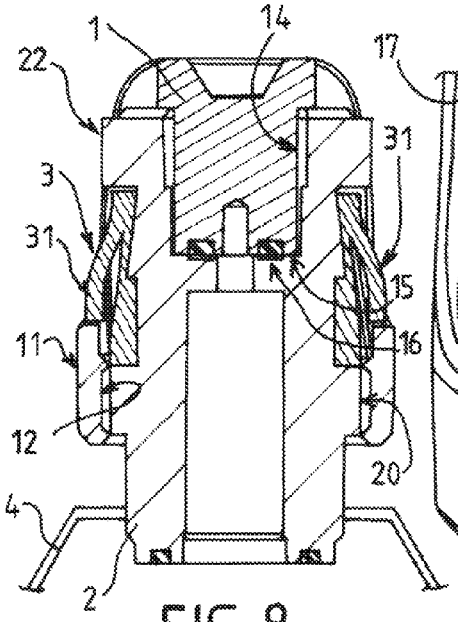
FIG. 8 is a schematic and partial view in longitudinal section showing a valve connector having the stopper in the fitted position.
Figure 9:
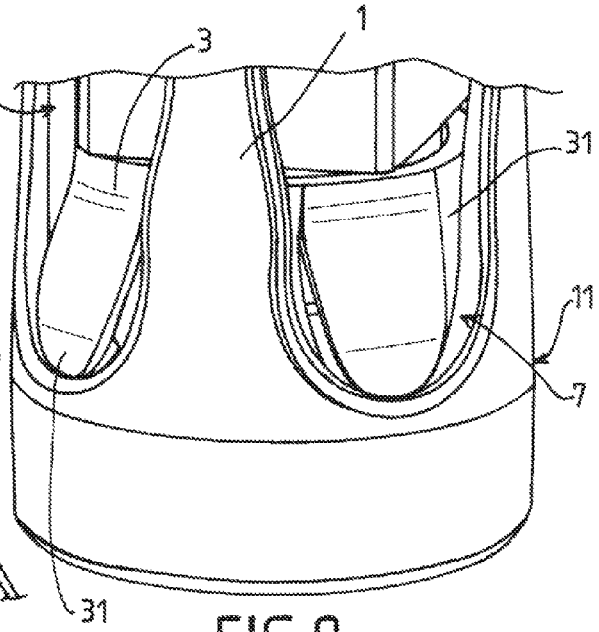
FIG. 9 is a perspective view of an enlarged detail of FIG. 8 of the valve connection fitted with the stopper.
Figure 10:
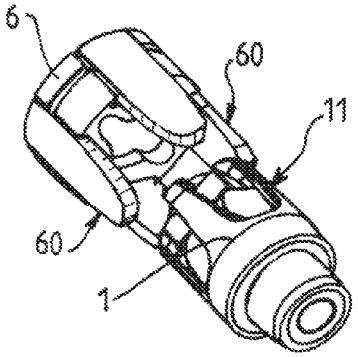
FIGS. 10 to 13 are perspective views each showing a different step in removing the stopper from the connector using a removing tool.

The inner surface of the sheath 11 comprises, moreover, at a second end opposite the first end, a spindle 14. The spindle 14 which is preferably integral with the sheath 11 extending inside the sheath 11 in a direction parallel to the longitudinal axis 13 towards the second end of the sheath 11 as far as a free end 15. The free end 15 is located between the first and second ends of the sheath 11, inside the sheath 11. In the described embodiment of a sealing stopper, said free end 15 of the spindle 14 comprises a sealing member 16 designed to press against a surface of a connector in order to create a seal (see FIG. 8). As shown, the sealing member 16 of the free end 15 of the spindle 14 comprises for example an O-ring housed in a circular groove formed on the free end 15 of the spindle 14. Also as shown, the free end 15 of the spindle 14 can comprise a blind hole at the centre of the seal 16 for receiving a projecting end of a stem of a check valve for closing the connector 2. Downstream of the check valve of the connector (not shown for the sake of simplicity), the connector 2 communicates with the internal circuit 7 of the valve to which it belongs.

Of course, where the application does not require a sealing stopper, it is possible for the spindle 14 not to have a seal.

As shown in the figures, the stopper 1 can be associated with an optional tamper-evident seal 3 showing that it has not been removed in an unauthorized manner. To that end, the sheath 11 comprises an open-work body having a plurality of lateral openings 17. The tamper-evident seal 3 is a part which is preferably separate from the sheath 11. The tamper-evident seal 3 is designed to be interposed between the connector 2 and the sheath 11 slipped and screwed onto the connector 2. In the example shown in FIGS. 2 to 6, 8 and 9, the tamper-evident seal 3 comprises, in the assembled position, a structure in the form of a collar having a plurality of flexible and frangible tabs 31. The tabs 31 are, in the normal position, deployed towards the outside of the collar. As can be seen in FIG. 2, the tamper-evident seal 3 can be formed by two identical or symmetrical half-shells which are fitted transversely around the connector 2.

The tamper-evident seal 3 is preferably interposed around the connector 2 between the guide end 22 and the threaded portion 20. For example, the tamper-evident seal 3 is blocked in this position in both longitudinal directions by shoulders including, for example, the guide end 22 and one or more other shoulders. The tamper-evident seal 3 is preferably also blocked in rotation on the connector 2 about the longitudinal axis in a determined position.

Figure 4:
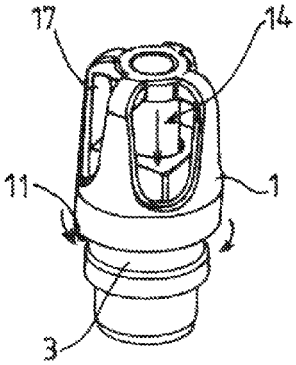
Figure 5:
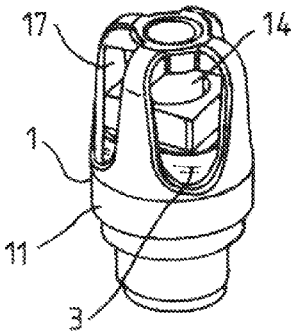
Figure 6:
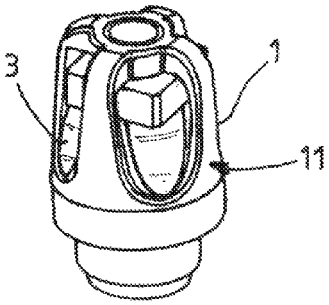

The sheath 11 of the stopper 1 can then be slipped onto the connector 2 fitted with the tamper-evident seal 3, by making the projections 23 coincide with the recesses 116 (FIGS. 3 and 4). The sheath 11 can then be screwed onto the connector 2. During these steps, the sheath 11 constricts and compresses the tabs 31 towards the connector into a retracted position which does not interfere with the rotation of the sheath 11.

In the fitted position, (see FIGS. 6, 8 and 9), the end 15 of the spindle 14 seals off the outlet of the connector and the tabs 31 line up with the openings 17 of the sheath 11. The tabs 31 can then return elastically to their natural deployed position through the openings 17. In this deployed position, the tabs 31 form stops preventing the stopper 1 from rotating relative to the connector 2. In this case, the untimely unscrewing of the sheath 11 breaks the breakable tabs 31 and thus the integrity of the tamper-evident seal 3.

Figure 11:
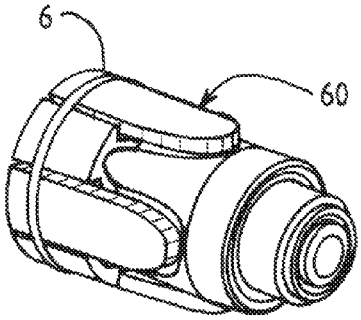
Figure 12:
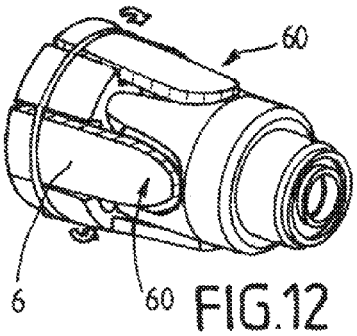
Figure 13:
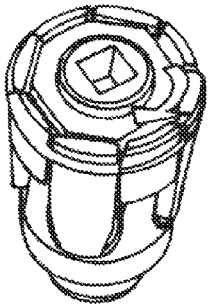
Figure 14:
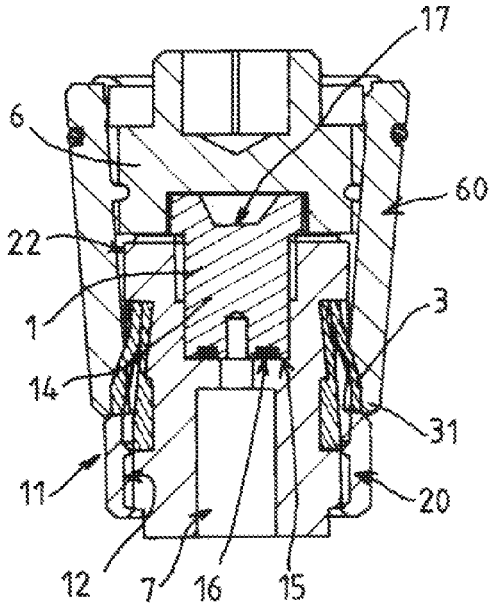
FIG. 14 is a view in longitudinal section showing a step in removing the stopper from its connector using a tool.

As can be seen in FIGS. 10 to 13, removing the stopper 1 without breaking the tamper-evident seal 3 can be done by compressing the tabs 31 towards the inside of the sheath 11 at the same time as unscrewing the stopper 1. As shown, this can be done using a selective removing (or fitting) tool 6 having a plurality of fingers 60 which mate with the openings 17 (see FIG. 10). The tool 6 is slipped over the sheath 11 (FIG. 11). The fingers 60 can be moved between a wide position (FIG. 11) and a retracted position (FIG. 12). In the retracted position, the fingers 60 press against the tabs 31 towards the inside of the sheath 11 to allow unrestricted rotation of the sheath 11 (FIGS. 13 and 14). To that end, the tool 6 also comprises a portion which rotates with the sheath 11. The tool 6 can be manual and/or automatic (pneumatic and/or electric and/or hydraulic).

Figure 16:
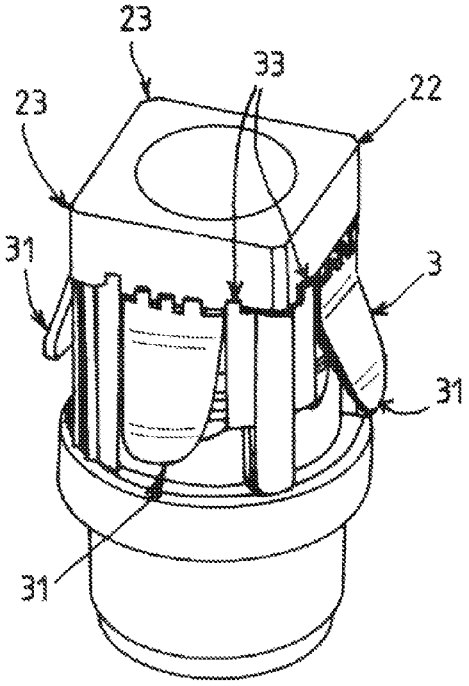
FIG. 16 is a perspective view showing the pre-fitting of the tamper-evident seal of FIG. 15 on a connector.
Figure 15:
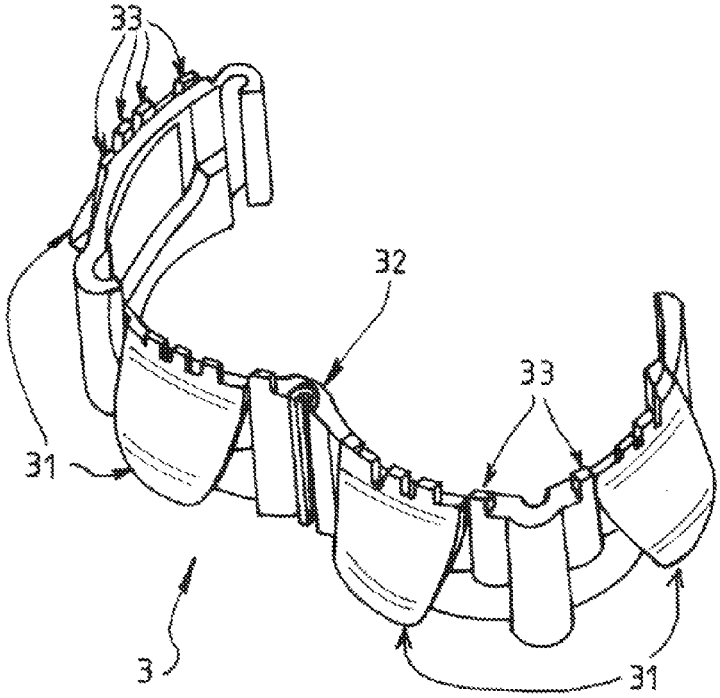
FIG. 15 is a perspective view showing a possible variant embodiment of a tamper-evident seal which can be used with the stopper.

FIG. 15 shows a possible variant embodiment of the optional tamper-evident seal 3. The tamper-evident seal 3 comprises a one-piece body in the shape of a crown. This tamper-evident seal 3 is open and has at least one pliable hinge 32. Moreover, as shown in FIG. 15, an edge of the tamper-evident seal 3 can comprise positioning snugs or pegs 33 which are intended to engage with the outer shape of the connector 2 to ensure that the tamper-evident seal 3 is in a determined angular position and is held around the connector 2. As can be seen in FIG. 16, pairs of snugs 33 can fit either side of each projection 23 of the guide end of the connector 2.

The tamper-evident seal 3 is preferably made of plastic.

The sheath 11 is preferably made of metal or of an alloy.

It is therefore easy to conceive that the structure of the stopper 1 can be used to provide a seal inside the connector 2 by ensuring reliable and secure fastening at the outer screw thread 20. This configuration provides a longitudinal compressive force between the end of the spindle 14 having the seal 16 and the inner surface of the connector 2. Similarly, when the spindle 14 has no seal (for a non-sealing stopper), this stopper structure with a spindle extending into the connector and which can press against the bottom of the connector increases the mechanical cohesion of the stopper on the connector.

The structure of the tamper-evident seal 3, use of which is optional, makes it possible to provide an indicator of untimely and unauthorized opening of the stopper. This makes it possible to ensure, in particular for the end user, the security conditions of the cylinder 5 having a valve 4 featuring such a connector 2.

Figure 17:
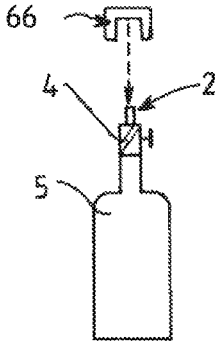
FIG. 17 is a schematic and partial illustration of the structure and working of how such a valve might be filled.

Such a stopper 1 can be fitted or replaced onto a connector 2 of a valve 4 of a cylinder 5 of fluid (acetylene, nitrogen, oxygen, etc.) after a stage of filling the cylinder 5 using a filling tool 66 (see FIG. 17).

The openings 17 of the stopper allow pressurized gas to be released by forming vents which limit the risk of the the stopper 1 working loose under pressure. In the event that the stopper 1 is of solid design (for example a sheath having no openings, in particular when the stopper has no tamper-evident seal), a lateral orifice can be provided in the stopper to act as a vent for releasing pressurized gas in order to avoid the risk of flying parts in the event of the stopper working loose under pressure with thread stripping in the threaded portion.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A stopper for fluid coupling of a valve of a pressurized fluid cylinder, the valve comprising a filling connector for filling with and withdrawing fluid, the stopper comprising: a self-locking sheath configured to slip onto the filling connector, the self-locking sheath extending about a central longitudinal axis, the self-locking sheath comprising, on an inner surface and at a first end, a tapped portion designed to engage with a threaded portion formed on an outer surface of the filling connector, wherein the tapped portion comprises at least one recess parallel to the central longitudinal axis in projection according to a plane perpendicular to the central longitudinal axis, the at least one recess being secant with a circle of smaller diameter of the tapped portion, and in that an inner surface of the self-locking sheath comprises, at a second end opposite the first end, a sealing spindle extending inside the self-locking sheath in a direction parallel to the central longitudinal axis towards the second end of the self-locking sheath as far as a free end located between the first and second ends of the self-locking sheath, the free end of the sealing spindle configured to form a protective cover for a surface of the filling connector designed to engage with a filling tool, the free end of the sealing spindle comprising a sealing member designed to press against a surface of the filling connector in order to create a seal, the sealing member of the free end of the sealing spindle comprising an O-ring housed in a circular groove formed on the free end of the sealing spindle, wherein the self-locking sheath comprises an open-work body having at least one opening, the stopper comprising a tamper-evident seal distinct from the self-locking sheath, the tamper-evident seal being designed to be interposed between the filling connector and the self-locking sheath, the tamper-evident seal comprising at least one flexible frangible tab, and in an assembled position, the at least one tab being deployed and projecting into the at least one opening of the self-locking sheath and acting as a stop preventing the self-locking sheath from rotating, the tab being able to be moved mechanically and elastically into a retracted position inside the self-locking sheath in order to selectively suppress the rotation-preventing stop, wherein the at least one opening is transverse to the central longitudinal axis thereby allowing access by the flexible frangible tab, wherein in the deployed position, the flexible frangible tabs project through the at least one opening, and wherein the flexible frangible tabs may be manually pushed into the at least one opening.

2. The stopper of claim 1, wherein the tapped portion comprises three or four recesses distributed symmetrically about an axis of rotation of the tapped portion.

3. The stopper of claim 1, wherein the tamper-evident seal comprises a body in the shape of a collar consisting of one or more parts, designed to be fitted around the filling connector, the body of the tamper-evident seal comprising the at least one flexible frangible tab deployed by default towards the outside of the collar and which can be pressed back elastically towards the inside of the collar in the retracted position.

4. The stopper of claim 1, wherein the self-locking sheath has a generally cylindrical shape.

5. The stopper of claim 1, wherein the tamper-evident seal is immobile in the longitudinal direction on the filling connector between two shoulders of the filling connector.

6. A valve for a pressurized fluid cylinder, comprising an internal gas circuit designed to communicate with an internal volume of a cylinder via at least one control member, the valve comprising a filling connector which communicates with the internal gas circuit for the purpose of filling the cylinder, the filling connector having a body which extends along a longitudinal axis, the filling connector comprising a guide end and a threaded portion, the threaded portion being offset in a longitudinal direction relative to said guide end in the direction of the central longitudinal axis, the guide end comprising a contour having at least one projection projecting beyond the contour in projection in a plane perpendicular to said central longitudinal axis, the at least one projection of the guide end of the filling connector being secant with a circle centered on said central longitudinal axis and the diameter of the circle is equal to the smaller of an inner and an outer diameter of the threaded portion, the valve comprising the stopper fitted in a removable fashion on the filling connector, wherein the stopper is in accordance with claim 1 and has a shape which mates with said connector, wherein the tapped portion of the stopper engages selectively with the threaded portion of the filling connector and the at least one recess of the stopper mates with the at least one projection of the guide end such that one or a limited number of given angular positions of the stopper on the filling connector allows the stopper to fit onto the filling connector such that these two can be screwed together.

7. A pressurized fluid cylinder comprising a valve wherein the valve is in accordance with claim 6.

8. A method for filling a pressurized fluid cylinder of claim 7, the method comprising a step of connecting a filling tool onto the filling connector which does not have a stopper, a step of transferring fluid into the cylinder via the filling tool through the filling connector, a step of disconnecting the filling tool from the filling connector and a step of fitting a stopper onto said connector.

9. The method of claim 8, further comprising, interposing a tamper-evident seal between the filling connector and the stopper.

10. The method of claim 8, further comprising, before the step of connecting a filling tool onto the filling connector, a step of removing a stopper present on the filling connector.

* * * * *